US006439091B1

(12) United States Patent
Dibbern et al.

(10) Patent No.: US 6,439,091 B1
(45) Date of Patent: Aug. 27, 2002

(54) CLUTCH MECHANISM

(75) Inventors: John E. Dibbern, Street; Dale K. Wheeler, Fallston; Friedrich J. Katz, deceased, late of Severna Park, all of MD (US), by Carol P. Katz, legal representative

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 09/294,036

(22) Filed: Apr. 19, 1999

(51) Int. Cl.[7] ..... B26D 1/14

(52) U.S. Cl. ..... 83/543; 83/666; 30/388

(58) Field of Search ..... 83/665, 666, 676, 83/698.41, 835, 543; 30/388, 347, 276; 192/56.1; 464/37; 451/508, 509, 519; 56/295

(56) References Cited

U.S. PATENT DOCUMENTS 1,518,634 A * 12/1924 Cason, Jr. ..... 464/37
1,548,427 A * 8/1925 Aldeen ..... 192/56.51
1,865,559 A * 7/1932 De Montgrand ..... 464/37
2,028,441 A * 1/1936 Decker ..... 173/13
2,256,496 A * 9/1941 Robinson ..... 464/37
2,491,976 A * 12/1949 Hauser ..... 83/665
2,519,848 A * 8/1950 Osterdahl ..... 192/56.5
2,572,042 A * 10/1951 Martin ..... 451/342
2,637,987 A * 5/1953 Hill et al. ..... 464/37
2,729,038 A * 1/1956 Hutchins ..... 451/509
2,803,103 A * 8/1957 Kollman ..... 56/295
2,978,858 A * 4/1961 Moody ..... 56/295
3,561,543 A * 2/1971 Ulbing ..... 173/93.5
3,596,446 A * 8/1971 Bryan ..... 464/39
3,774,379 A * 11/1973 Mizobata et al. ..... 30/264
4,053,980 A * 10/1977 Poehlman ..... 464/38
4,205,572 A * 6/1980 Weiner ..... 83/666
4,343,214 A * 8/1982 Schadlich ..... 83/666
4,480,736 A * 11/1984 Loizeau ..... 464/57
4,766,641 A * 8/1988 Daglow ..... 192/56.1
4,941,790 A * 7/1990 Kirn ..... 411/432
4,991,473 A * 2/1991 Gotman ..... 192/89.22
5,000,721 A * 3/1991 Williams ..... 464/37
5,060,772 A * 10/1991 Anders et al. ..... 192/56.54
5,099,970 A * 3/1992 Harris ..... 192/56.1
5,293,798 A * 3/1994 Otani et al. ..... 83/665
5,566,458 A * 10/1996 Bednar ..... 464/36
5,667,347 A * 9/1997 Matthews ..... 83/543
5,707,275 A * 1/1998 Preis et al. ..... 451/509
5,810,533 A * 9/1998 Nakamura ..... 411/432
5,871,322 A * 2/1999 Nakamura ..... 411/432

* cited by examiner

*Primary Examiner*—Allan N. Shoap
*Assistant Examiner*—Stephen Choi
(74) *Attorney, Agent, or Firm*—Adan Ayala

(57) ABSTRACT

A power tool includes a motor, an arbor driven by the motor, a rotatable cutting tool disposed on the arbor and having a rotational axis, the cutting tool further having a hole, first and second clamps connected to the arbor and clamping the blade, wherein one of the cutting tool and at least one of the first and second clamps and arbor have a first drive surface for contacting a second drive surface on the other of the cutting tool and the at least one of the first and second clamps and arbor, the second drive surface being movable between a first position contacting the first drive surface and a second position bypassing the first drive surface. The second drive surface is resiliently connected to the other of the cutting tool and the at least one of the first and second clamps and arbor. At least one metal strip connects the second drive surface to the other of the blade and the at least one of the first and second clamps and arbor.

3 Claims, 8 Drawing Sheets

CLUTCH MECHANISM

FIELD OF THE INVENTION

This invention relates generally to clutch mechanisms for tools.

BACKGROUND OF THE INVENTION

Referring to FIG. 1, a circular saw blade 10 is normally driven by a rotating arbor 20 operatively connected to a motor (not shown) of a power tool. In many applications, the blade 10 has a circular hole 11 through the center for acceptance of the arbor 20. The arbor 20 may often have a smaller diameter mounting portion 21 which extends from a larger primary portion of the drive arbor to form a shoulder 22. The blade 10 is typically placed over the smaller diameter mounting portion 21 until it is stopped against the shoulder 22 formed by the main drive portion of the arbor 20. The blade 10 is then locked on to the arbor by clamping it between the shoulder 22 and either a threaded locking nut 23 which is threaded onto the end of the small diameter mounting portion 21 (see, e.g., U.S. Pat. Nos. 5,477,845 and 5,303,688) or a bolt threaded into a threaded hole in the end of the arbor (see, e.g., U.S. Pat. No. 5,303,688). Sometimes, a blade clamp 24 may be disposed between the blade 10 and the shoulder 22. Similarly, a second blade clamp 25 and/or a washer 46 may be disposed between blade 10 and nut 23. The blade 10 then rotates with the arbor 20 because of the clamping force.

Sometimes because of the clamping force, the blade 10 may stop rotational movement of arbor 20 when blade 10 gets caught by a workpiece. Such lack of movement may damage the motor or gears connecting the motor to arbor 20.

SUMMARY OF THE INVENTION

In accordance with the present invention, an improved power tool is employed. A power tool includes a motor, an arbor driven by the motor, a rotatable cutting tool disposed on the arbor and having a rotational axis, the cutting tool further having a hole, first and second clamps connected to the arbor and clamping the blade, wherein one of the cutting tool and at least one of the first and second clamps and arbor have a first drive surface for contacting a second drive surface on the other of the cutting tool and the at least one of the first and second clamps and arbor, the second drive surface being movable between a first position contacting the first drive surface and a second position bypassing the first drive surface. The second drive surface is resiliently connected to the other of the cutting tool and the at least one of the first and second clamps and arbor. At least one metal strip connects the second drive surface to the other of the blade and the at least one of the first and second clamps and arbor.

Additional features and benefits of the present invention are described, and will be apparent from, the accompanying drawings and the detailed description below.

BRIEF DESCRIPTION OF THE DRAWINGS

The accompanying drawings illustrate preferred embodiments of the invention according to the practical application of the principles thereof, and in which:

FIG. 3 is a close-up view of FIG. 2, where

FIG. 5 is a close-up view of FIG. 4, where

FIG. 7 is a close-up view of FIG. 6, where

FIG. 9 is a close-up view of FIG. 8, where

FIG. 11 is a close-up view of FIG. 10, where

DETAILED DESCRIPTION

The invention is now described with reference to the accompanying figures, wherein like numerals designate like parts. Persons skilled in the art will recognize that the following invention can be used in any power or hand tool using a circular blade, abrasive wheel or other rotatable cutting tools. These power or hand tools include miter saws, table saws, circular saws, drills, etc.

Figure 1:
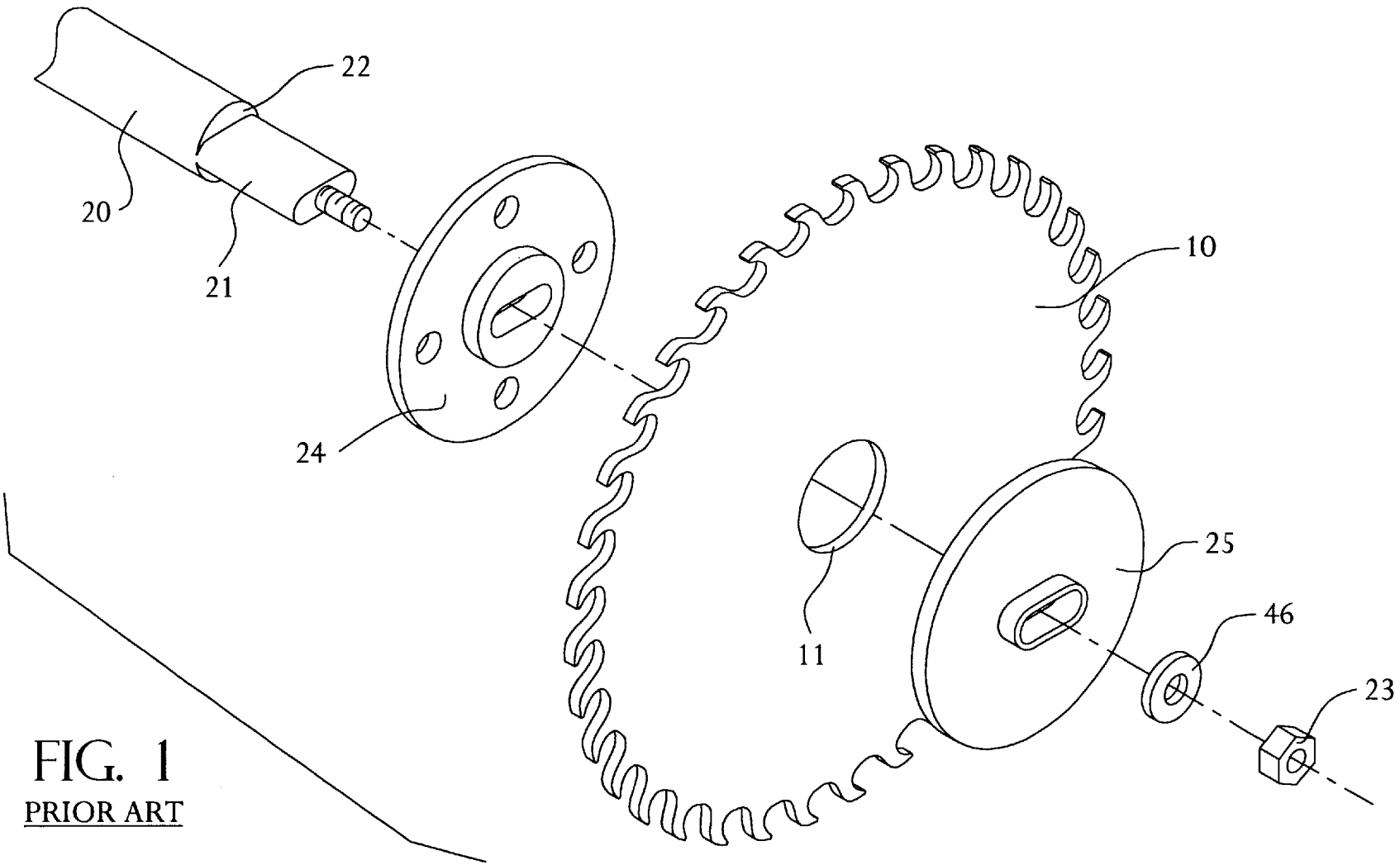
FIG. 1 PRIOR ART
FIG. 1 is an exploded perspective view of a typical prior art arbor and saw blade.
Figure 2:
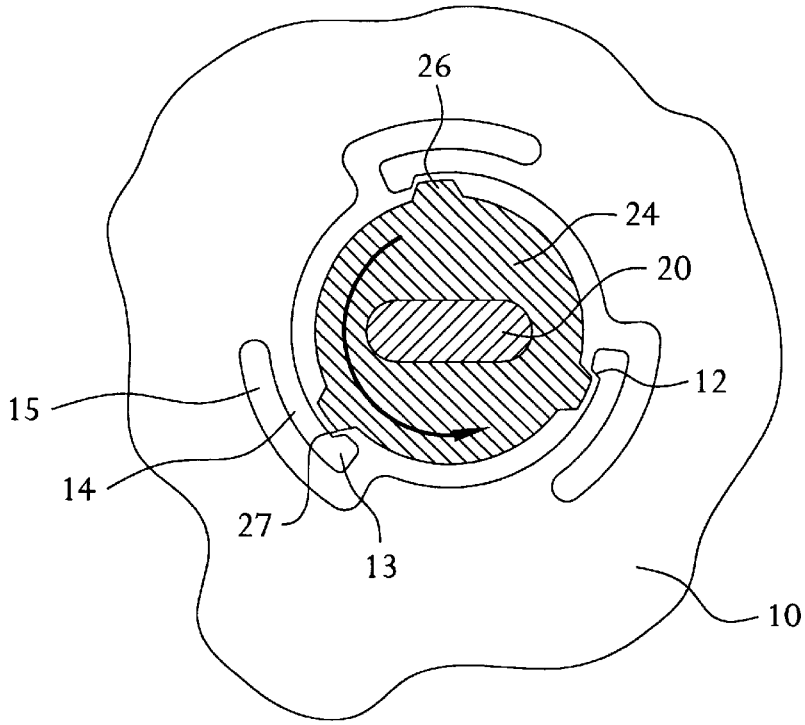
FIG. 2 is a partial cross-sectional view of a first embodiment of the present invention.

FIG. 2 illustrates a first embodiment of the invention. Blade 10 is disposed on arbor 20, as in the prior art. Preferably, first clamp 24 will be disposed between arbor 20 and blade 10 as in the prior art. A second clamp 25 (not shown) may also be used to clamp blade 10, as in the prior art.

First clamp 24 may have at least one protrusion 26, which in turn may have a drive surface 27 contacting blade 10. Preferably, drive surface 27 contacts a drive surface 12. Either drive surfaces 12, 27 or both may be inclined. Drive surface 12 may be disposed on a protrusion 13, which may be resiliently connected to blade 10 via a strip 14. Strip 14 is preferably made of metal. Blade 10 may also have a gap 15 between blade 10 and strip 14. Such gap 15 allows compression of protrusion 13.

Figure 3A:
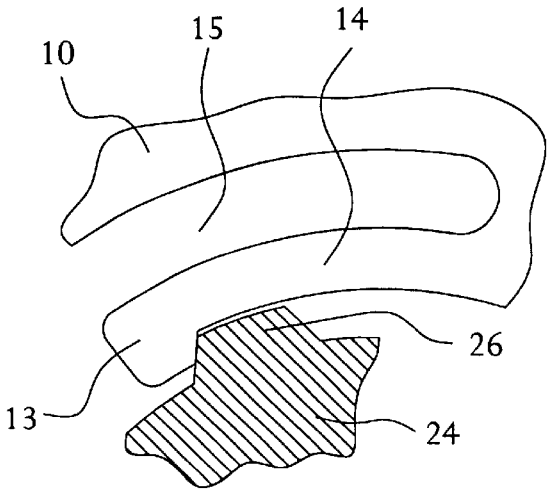
FIG. 3A illustrates the mounting device driving,the blade.

With such arrangement, clamp 24 drives blade 10 because of the contact between drive surfaces 12, 27, as shown in FIG. 3A. If the blade 10 gets caught in a workpiece, drive surface 12 will slide along drive surface 27. Accordingly, protrusion 13 will be pushed towards gap 15, and thus compressed, allowing protrusion 26 to bypass protrusion 13. In other words, drive surface 27 will bypass drive surface 12. In this manner, arbor 20 may continue rotating without damage to the motor.

Persons skilled in the art will recognize that protrusions 26 with drive surfaces 27 may be disposed on the arbor 20, the first clamp 24 and/or second clamp 25. In other words, protrusions 26 may be disposed on any combination of the arbor 20, and the first and second clamps 24, 25. Furthermore, more than one protrusion 26 may be provided thereon so that all protrusions 26 drive blade 10 simultaneously. Alternatively, protrusions 26 may be staggered so that a first set contact blade 10 at one time, and a second set contact blade 10 after the first set bypasses the protrusions 13 for the first time, etc.

Figure 4:
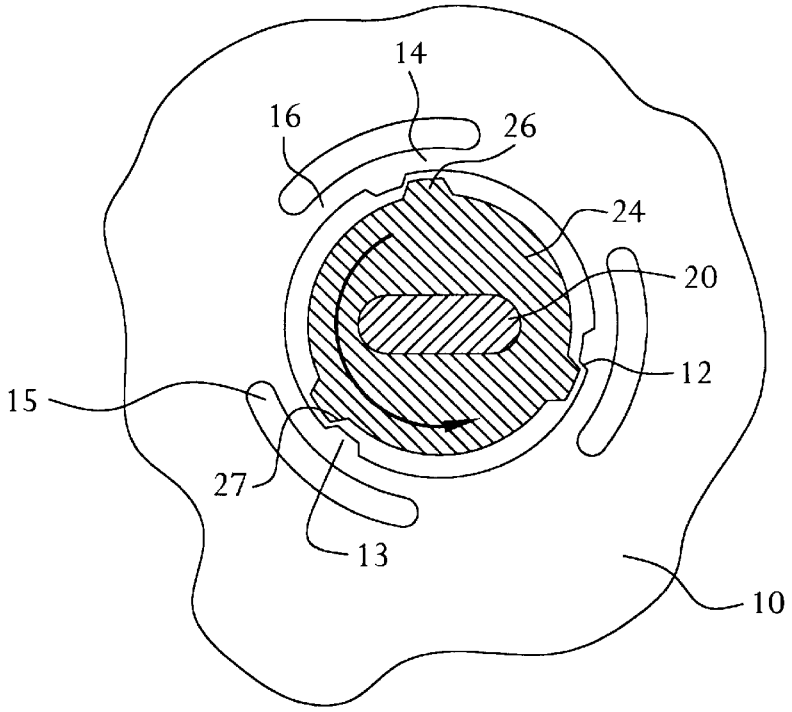
FIG. 4 is a partial cross-sectional view of a second embodiment of the present invention.
Figure 5A:
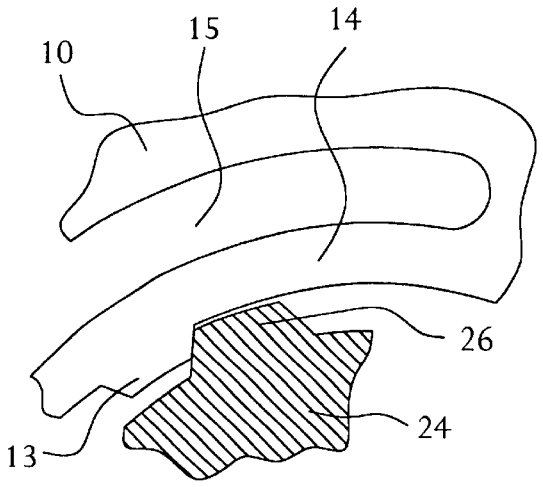
FIG. 5A illustrates the mounting device driving the blade.
Figure 5B:
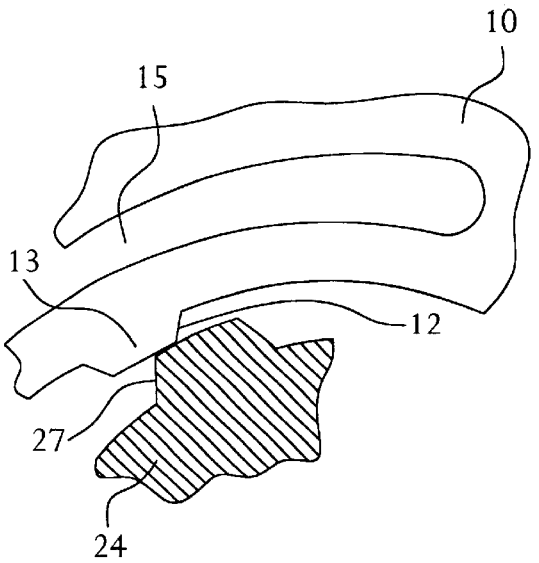
FIG. 5B illustrates the mounting device bypassing the blade.

FIGS. 4–5B illustrate a second embodiment of the invention, which operates in a similar way to the first embodiment. All the teachings of the first embodiment are incorporated by reference herein. Further like numerals refer to like parts.

The main difference between the second embodiment and the first embodiment is that protrusion 13 is no longer "floating" as in the first embodiment. Instead, a second strip 16 connects protrusion 13 to blade 10. Strip 16 is preferably made of metal. Further, strip 16 may resiliently connect protrusion 13 to blade 10.

Figure 3B:
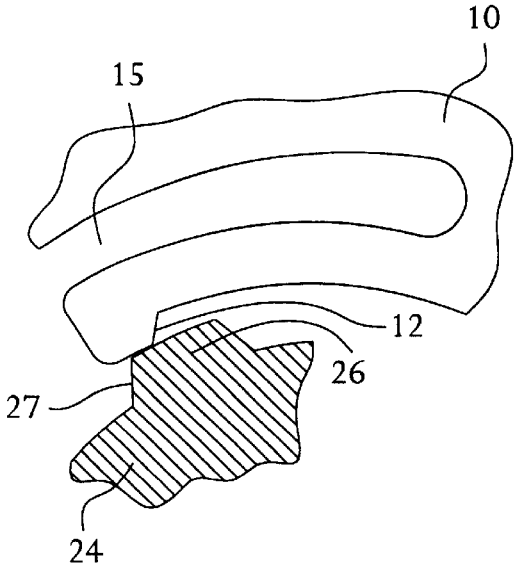
FIG. 3B illustrates the mounting device bypassing the blade.

The operation of such arrangement is illustrated in FIGS. 5A and 5B, and is similar to the operation of the first embodiment, as disclosed above and shown in FIGS. 3A and 3B.

Figure 6:
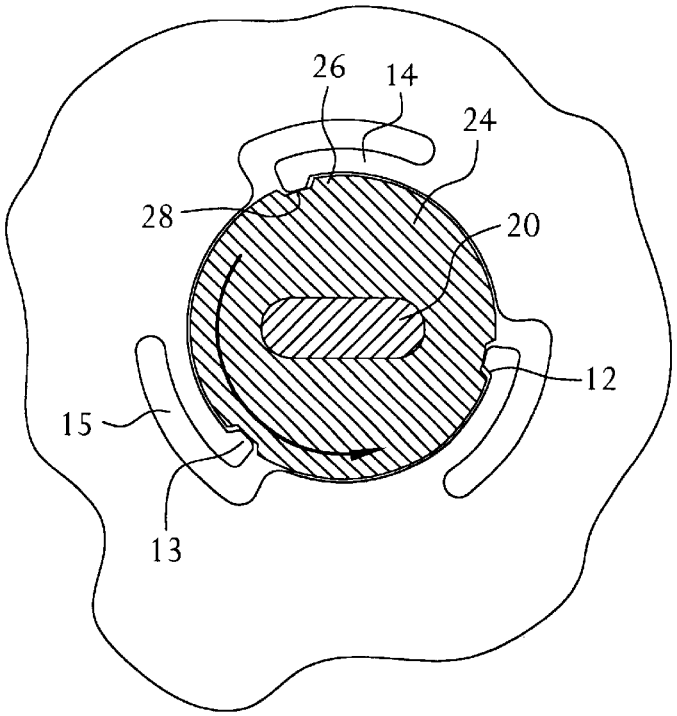
FIG. 6 is a partial cross-sectional view of a third embodiment of the present invention.
Figure 7A:
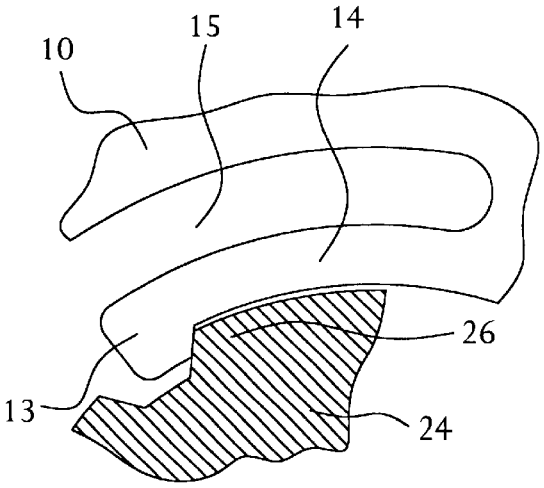
FIG. 7A illustrates the mounting device driving the blade.
Figure 7B:
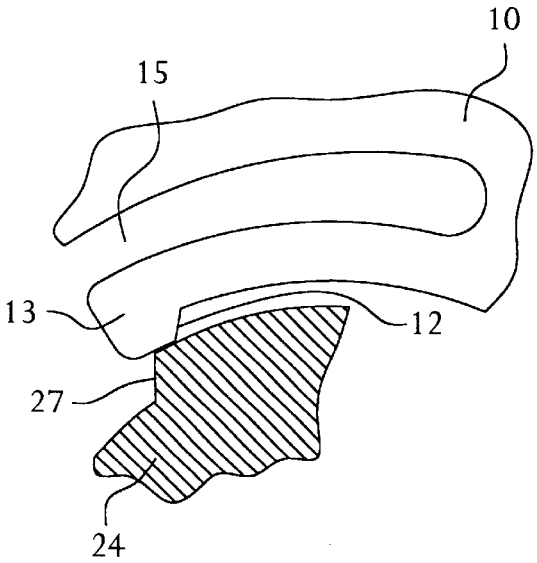
FIG. 7B illustrates the mounting device bypassing the blade.

FIGS. 6–7B illustrate a third embodiment of the invention, which operates in a similar way to the first embodiment. All the teachings of the first embodiment are incorporated by reference herein. Further like numerals refer to like parts.

The main difference between the third embodiment and the first embodiment is that protrusion 26 now extended over a larger portion of the periphery of clamp 24. Accordingly, two protrusions 26 now define a depression 28 for receiving protrusion 13.

The operation of such arrangement is illustrated in FIGS. 7A and 7B, and is similar to the operation of the first embodiment, as disclosed above and shown in FIGS. 3A and 3B.

Figure 8:
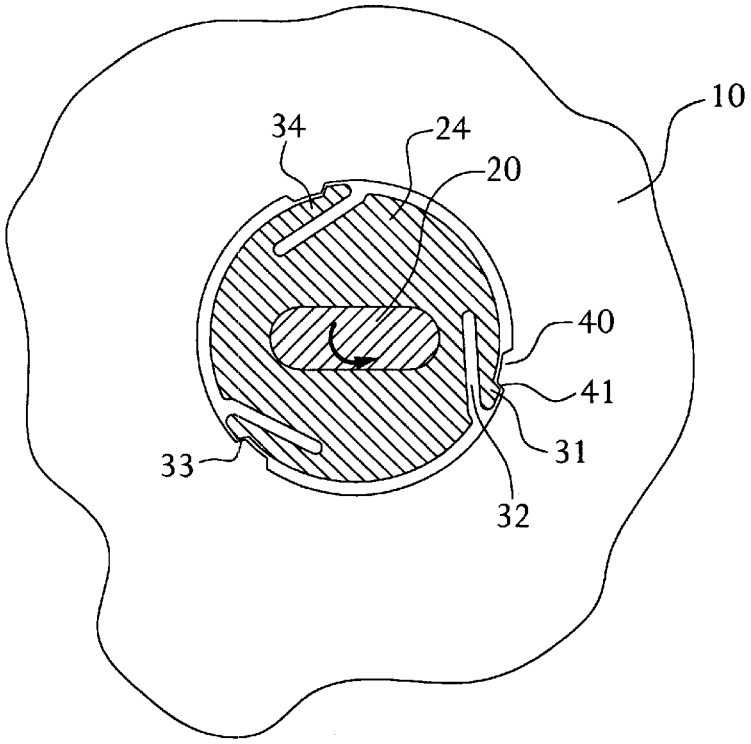
FIG. 8 is a partial cross-sectional view of a fourth embodiment of the present invention.

FIG. 8 illustrates a fourth embodiment of the invention which operates in a similar way to the first embodiment. All the teachings of the first embodiment are incorporated by reference herein. Further like numerals refer to like parts.

As before, blade 10 is disposed on arbor 20, as in the prior art. Preferably, first clamp 24 will be disposed between arbor 20 and blade 10 as in the prior art. A second clamp 25 (not shown) may also be used to clamp blade 10, as in the prior art.

First clamp 24 may have at least one protrusion 31, which in turn may have a drive surface 33 contacting blade 10. Preferably, drive surface 33 contacts a drive surface 41. Either drive surfaces 33, 41 or both may be inclined. Drive surface 41 may be disposed on a protrusion 40, which may be disposed on the periphery of the blade hole 11.

Further, protrusion 31 may resiliently connected to first clamp 24 via a strip 34. Strip 34 is preferably made of metal. First clamp 24 may also have a gap 32 between first clamp 24 and strip 34. Such gap 32 allows compression of protrusion 31.

Figure 9A:
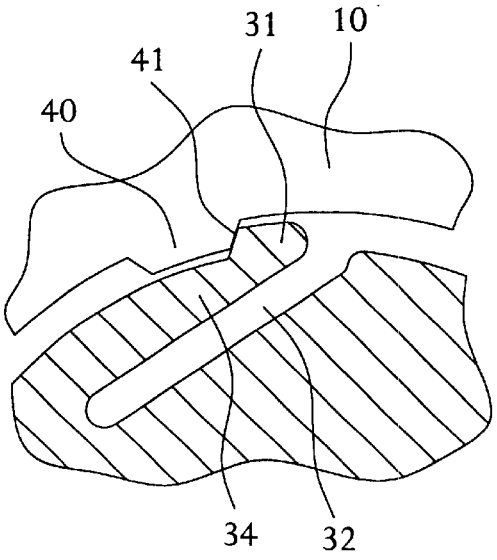
FIG. 9A illustrates the mounting device driving the blade.

With such arrangement, clamp 24 drives blade 10 because of the contact between drive surfaces 33, 41, as shown in FIG. 9A. If the blade 10 gets caught in a workpiece, drive surface 33 will slide along drive surface 41. Accordingly, protrusion 31 will be pushed towards gap 32, and thus compressed, allowing protrusion 40 to bypass protrusion 31. In other words, drive surface 41 will bypass drive surface 33. In this manner, arbor 20 may continue rotating without damage to the motor.

Persons skilled in the art will recognize that protrusions 31 with drive surfaces 33 may be disposed on the arbor 20, the first clamp 24 and/or second clamp 25. In other words, protrusions 31 may be disposed on any combination of the arbor 20, and the first and second clamps 24, 25. Furthermore, more than one protrusion 31 may be provided thereon so that all protrusions 31 drive blade 10 simultaneously. Alternatively, protrusions 31 may be staggered so that a first set contact blade 10 at one time, and a second set contact blade 10 after the first set bypasses the protrusions 13 for the first time, etc.

Figure 10:
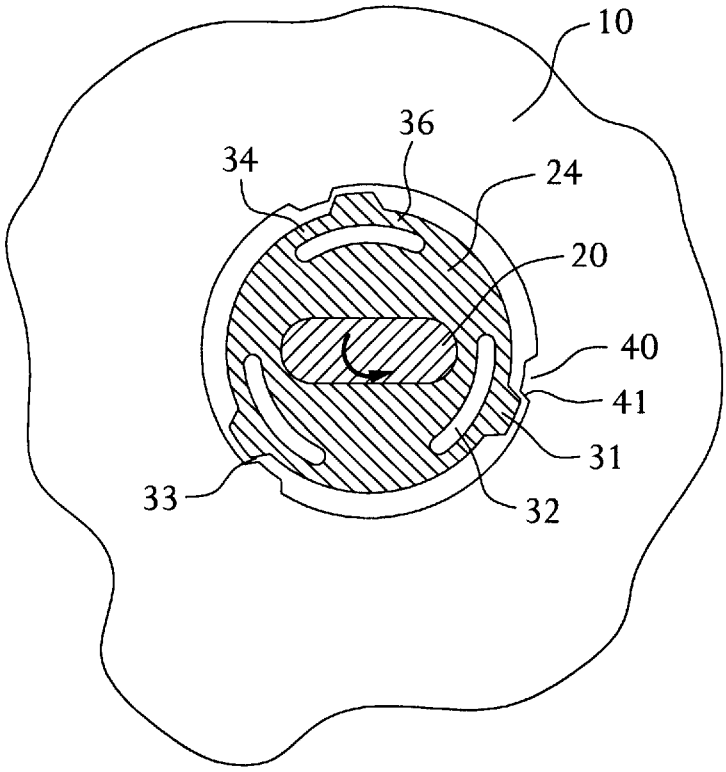
FIG. 10 is a partial cross-sectional view of a fifth embodiment of the present invention.
Figure 11A:
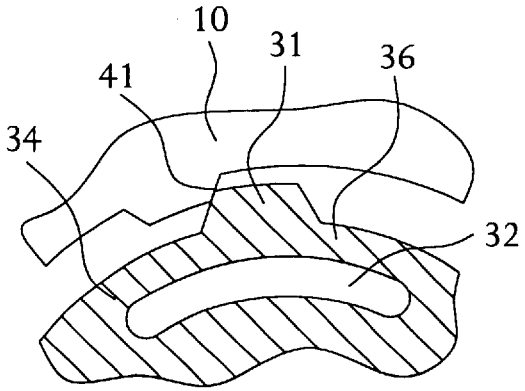
FIG. 11A illustrates the mounting device driving the blade.
Figure 11B:
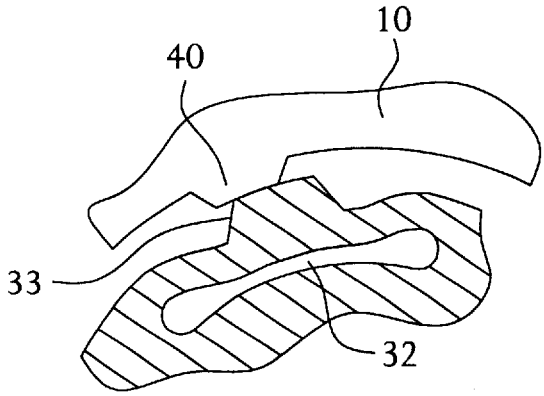
FIG. 11B illustrates the mounting device bypassing the blade.

FIGS. 10–11B illustrate a fifth embodiment of the invention, which operates in a similar way to the second and fourth embodiments. All the teachings of the second and fourth embodiments are incorporated by reference herein. Further like numerals refer to like parts.

The main difference between the firth embodiment and the fourth embodiment is that protrusion 31 is no longer "floating" as in the fourth embodiment. Instead, a second strip 36 connects protrusion 31 to first clamp 24. Strip 36 is preferably made of metal. Further, strip 36 may resiliently connect protrusion 31 to first clamp 24.

Figure 9B:
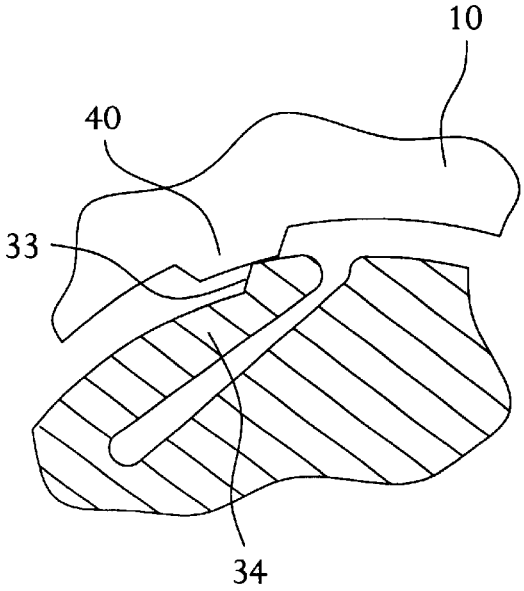
FIG. 9B illustrates the mounting device bypassing the blade.

The operation of such arrangement is illustrated in FIGS. 11A and 11B, and is similar to the operation of the fourth embodiment, as disclosed above and shown in FIGS. 9A and 9B.

Persons skilled in the art will understand that it is preferable to maximize the contact areas between the two protrusions in the above embodiments in order to minimize stripping.

Figure 12:
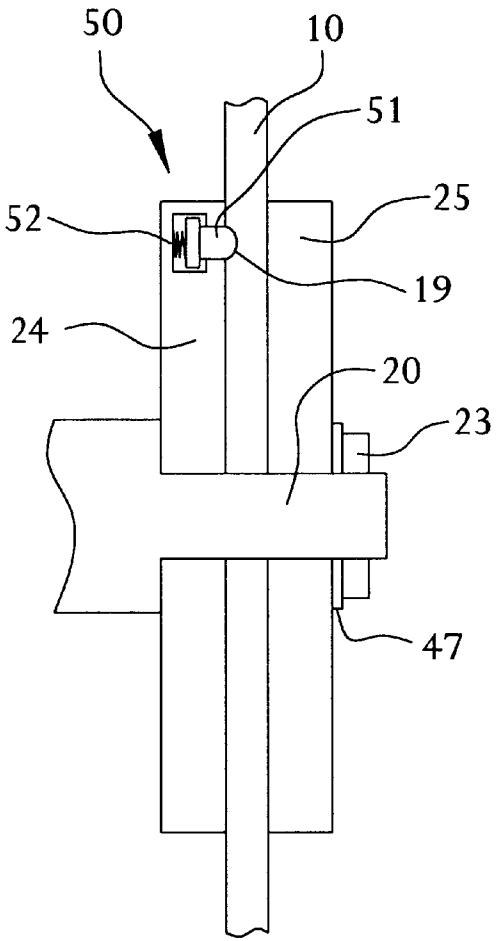
FIG. 12 is a partial cross-sectional view of a sixth embodiment of the present invention.

FIG. 12 illustrates a sixth embodiment of the invention which operates in a similar way to the first embodiment. All the teachings of the first embodiment are incorporated by reference herein. Further like numerals refer to like parts.

As before, blade 10 is disposed on arbor 20, as in the prior art. Preferably, first clamp 24 will be disposed between arbor 20 and blade 10 as in the prior art. A second clamp 25 (not shown) may also be used to clamp blade 10, as in the prior art. A nut 23 may be used to maintain all these elements on the arbor 20.

First clamp 24 may have at least one detent mechanism 50, which in turn may comprise a detent 51 for engaging a recess 19 on blade 10. Preferably detent 51 is made of metal, and may have a rounded end which engages recess 19. Detent 51 may be biased towards recess 19 (and thus blade 10) by a spring 52.

With such arrangement, if the blade 10 gets caught in a workpiece, detent 51 may disengage recess 19, allowing arbor 20 to continue rotating without damage to the motor. In other words, detent 51 may move between a first position engaging recess 19 and a second position bypassing recess 19

Figure 13:
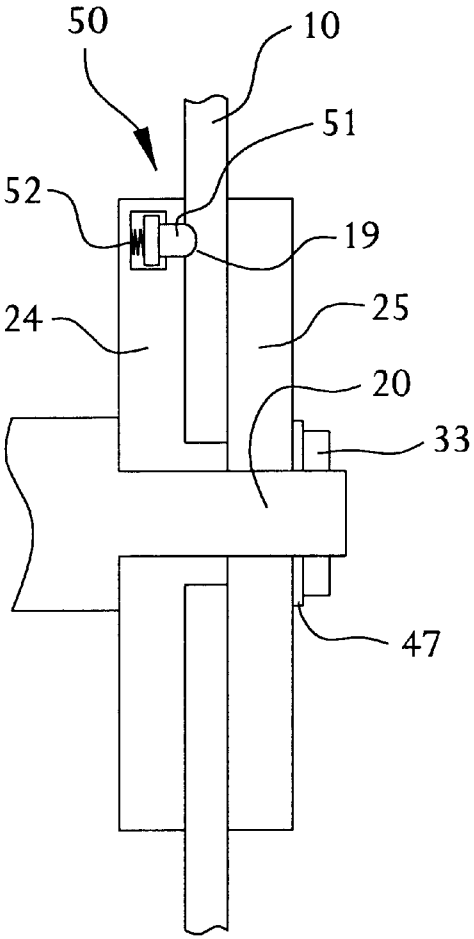
FIG. 13 is a partial cross-sectional view of a seventh embodiment of the present invention.
Figure 15:
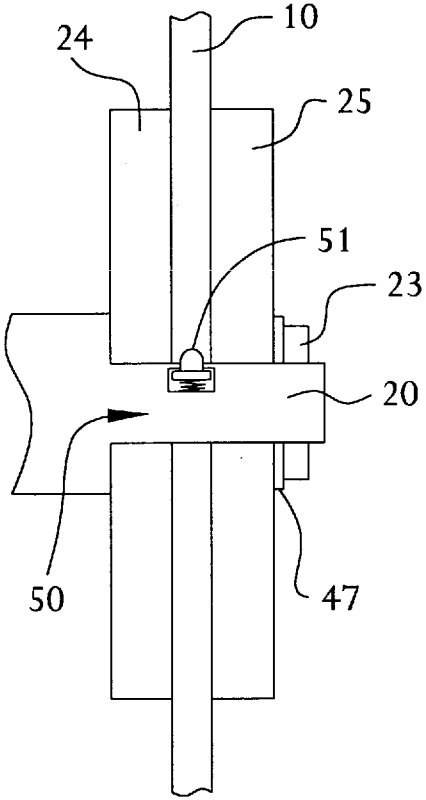
FIG. 15 is a partial cross-sectional view of a ninth of the present invention.
Figure 14:
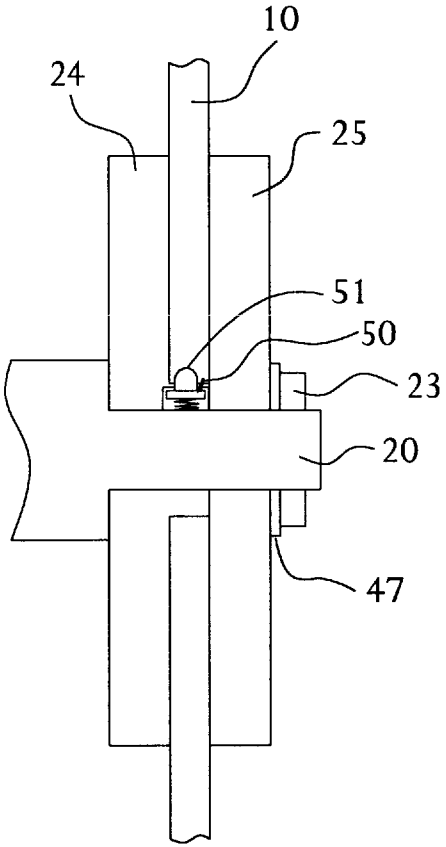
FIG. 14 is a partial cross-sectional view of an eight embodiment of the present invention.

Persons skilled in the art will recognize that blade 10 may be disposed wholly on first clamp 24, rather than on arbor 20, as shown in FIG. 13. Further, persons skilled in the art should recognize that detent mechanism 50 may be disposed on the arbor 20, as shown in FIG. 15. Similarly, people should recognize that the detent 51 preferably moves between the first and second positions along a vector which is parallel to the rotational axis of blade 10 (or the longitudinal axis of arbor 20), as shown in FIGS. 12–13 and 16, or along a vector substantially perpendicular to the rotational axis of blade 10 (or the longitudinal axis of arbor 20), as shown in FIGS. 14–15.

Figure 16:
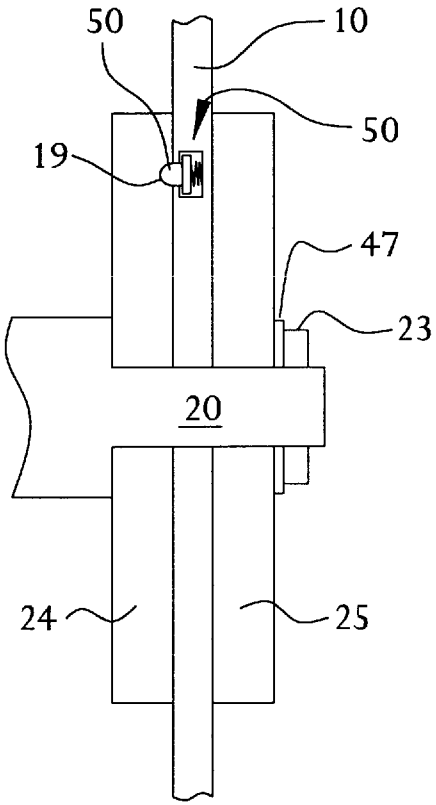
FIG. 16 is a partial cross-sectional view of a tenth of the present invention.

Persons skilled in the art should also recognize that detent 51 and recess 19 may be disposed on blade 10 and first clamp 24, respectively, as shown in FIG. 16. Further, persons skilled in the art should also recognize that detent 51 and recess 19 may be disposed on blade 10 and arbor 20, respectively.

Persons skilled in the art will recognize that, in the above embodiments, it is preferable not to use excessive clamping force to clamp the blade 10, as such force could prevent the blade 10 remaining stationary and allowing the bypass of protrusions 26. To prevent overtightening and/or overclamping, an operator may use a torque wrench. Alternatively, a washer 47 may be used to prevent overtightening. Preferably, washer 47 is made of an elastomeric material. Alternatively, washer 47 may be a bowed, or springy washer.

Persons skilled in the art may recognize other alternatives to the means disclosed herein. However, all these additions and/or alterations are considered to be equivalents of the present invention.

What is claimed is:

1. A power tool comprising:

a motor;

an arbor driven by the motor;

a rotatable cutting tool disposed on the arbor and having a rotational axis, the cutting tool further having a hole;

first and second clamps connected to the arbor and clamping the cutting tool;

wherein one of the cutting tool and at least one of the first and second clamps and arbor have a first drive surface for contacting a second drive surface on the other of the cutting tool and the at least one of the first and second clamps and arbor, said second drive surface being movable between a first position contacting the first drive surface and a second position bypassing the first drive surface, the second drive surfaces moving towards the second position in a direction non-parallel to the rotational axis.

2. The power tool of claim 1, wherein the second drive surface is resiliently connected to the other of the cutting tool and the at least one of the first and second clamps and arbor.

3. The power tool of claim 1, wherein at least one metal strip connects the second drive surface to the other of the cutting tool and the at least one of the first and second clamps and arbor.

* * * * *